US006972528B2

(12) United States Patent
Shao

(10) Patent No.: US 6,972,528 B2
(45) Date of Patent: Dec. 6, 2005

(54) STRUCTURE FOR LED LIGHTING CHAIN

(75) Inventor: Chiliang Shao, Apex Chance Industry Co., Ltd., Dengwu District, Qiaotou Town, Dongguan City, Guangdong Province (CN) 523520

(73) Assignees: Chiliang Shao, (CN); Jinhong Deng, (CN)

( * ) Notice: Subject to any disclaimer, the term of this patent is extended or adjusted under 35 U.S.C. 154(b) by 0 days.

(21) Appl. No.: 10/836,062

(22) Filed: Apr. 29, 2004

(65) Prior Publication Data

US 2005/0110426 A1 May 26, 2005

(30) Foreign Application Priority Data

Nov. 21, 2003 (CN) ..... 20032011295 A

(51) Int. Cl.[7] ..... F21V 29/00
(52) U.S. Cl. ..... 315/185 R; 315/185 S; 362/249; 362/252
(58) Field of Search ..... 315/185 R, 185 S, 315/200 A, 200 R, 188–189, 312, 318, 316, 315/324, 207; 362/219, 800, 806, 249, 252

(56) References Cited

U.S. PATENT DOCUMENTS 6,461,019 B1 10/2002 Allen ..... 362/249
6,641,294 B2 * 11/2003 Lefebvre ..... 362/249
6,830,358 B2 * 12/2004 Allen ..... 315/185 R

* cited by examiner

*Primary Examiner*—Wilson Lee
(74) *Attorney, Agent, or Firm*—Thorpe North & Western, LLP

(57) ABSTRACT

An improved structure for LED lighting comprising an AC to DC converter, said converter comprising four rectifying diodes, and at least one LED serial set. The rectifying diodes can be divided into a first and second group, each group comprising two diodes. The negative ends of the two rectifying diodes of the first group can be connected in parallel and their positive ends can be connected with a positive and negative end of the front and rear plugs respectively. The positive ends of the two rectifying diodes of the second group can be connected together in parallel and their negative ends can be connected with the positive and negative ends of the front and rear plugs respectively. The LED serial set can be connected between the negative end of the rectifying diodes of the first group and the positive end of the rectifying diodes of the second group.

19 Claims, 2 Drawing Sheets

STRUCTURE FOR LED LIGHTING CHAIN

This application claims priority to Chinese Application No. 20032011295.X, filed Nov. 21, 2003.

FIELD OF THE INVENTION

The present invention relates to the field of decorative lighting and particularly an improved structure for an LED lighting chain.

BACKGROUND

Decorative lighting is often used in and around the household. LED decorative lighting, with its colorful lights, can be used for decorating effects in the yard and for lighting in the house. To acquire more market shares, decorative light manufacturers are working hard on the research and development of new products that are easy to use and with better effects.

The use of a DC power supply to power LED lighting can best optimize the advantages of LED lights, which includes high brightness and non-glittering. Use of an AC power supply can lead to a shortened lifespan of LED lights.

FIG. 1 shows a prior art embodiment of an LED lighting chain. The prior art has a front plug (01), which can be connected to an AC power supply and a rear plug 02. The positive and negative terminals of the front and rear plugs are connected using a power cord. Between the front and rear plugs, there is an AC/DC converter 03. The output end of the AC/DC converter 03 is connected with at least one serial set of LED lights (04) comprising multiple (for example, 100) LED lights with a serial connection. FIG. 1 shows only one LED serial set 04. In a case where multiple LED serial sets are used, a parallel connection can be adopted to allow the same voltage at the two ends of each LED serial set 04.

The AC/DC converter, as shown in FIG. 2, is a bridge-type rectifying device using four leading wires, 231, 232, 233 and 234. This not only impairs the visual effect of the lighting chain, but also leads to a higher cost. In addition, since there is typically not a voltage reducing device in LED serial set 04, the number of LEDs used in the LED serial set 04 typically must be a set amount. For example, with a rated voltage drop of 2.2 volts for each LED, the LED serial set must have 100 (in the case of 220V power supply) or 50 (in the case of 110V power supply). This can greatly reduce the flexibility of current LED lighting chain products.

SUMMARY OF THE INVENTION

In view of the disadvantages of the prior art, the object of the present invention is to provide an improved structure for an LED lighting chain that can solve the problems mentioned previously.

To attain the aforesaid object, the present invention employs a front plug, a rear plug, an AC/DC converter consisting of four rectifying diodes, and at least one LED serial set. In a case where multiple LED sets are used, a parallel connection can be adopted.

The said rectifying diodes can be divided into two groups, with each group including two rectifying diodes. The negative ends of the two rectifying diodes of the first group are connected in parallel and their positive ends are connected with wires connecting the positive and negative ends of the front and rear ends respectively. As for the two rectifying diodes of the second group, their positive ends are connected together and their negative ends are connected with wires connecting the positive and negative ends of the front and rear plugs respectively. The said LED serial set is connected between the negative end of the rectifying diodes of the first group and the positive end of the rectifying diodes of the second group.

In a more detailed aspect, as an improvement made to the aforesaid technical solution, a voltage-reducing device can be installed between multiple LED serial sets connected in parallel and the positive end of the rectifying diodes of the second group.

By means of the aforesaid system, four rectifying diodes are divided into two groups and the LED serial set is set up between these two groups. This can help by reducing the wire count by one wire and can contribute to a simplified structure, improved visual effect, and reduced manufacturing cost.

DETAILED DESCRIPTION

Figure 1:
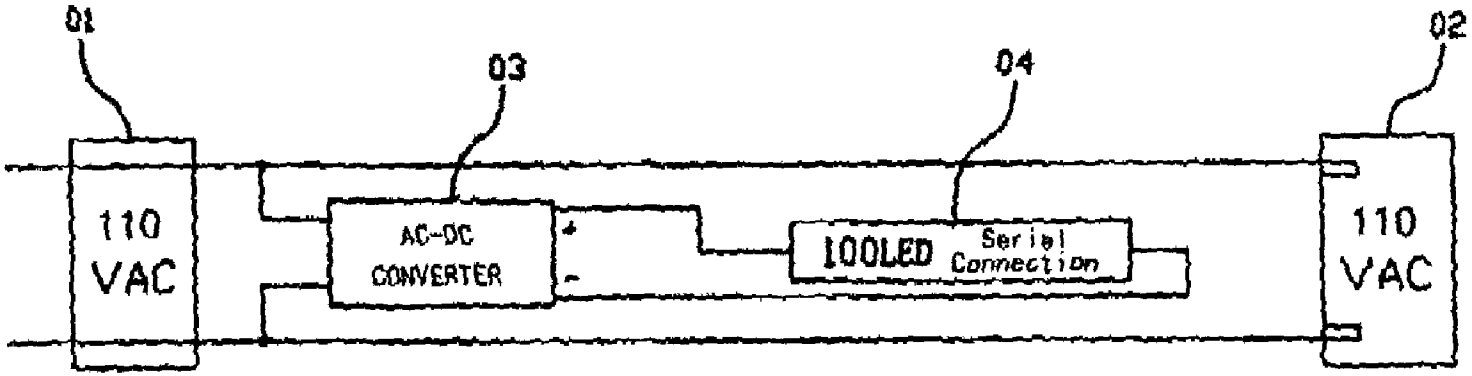
Fig 1 (Prior Art)
FIG. 1 is the prior art schematic circuit diagram of conventional decorative lighting chain.
Figure 2:
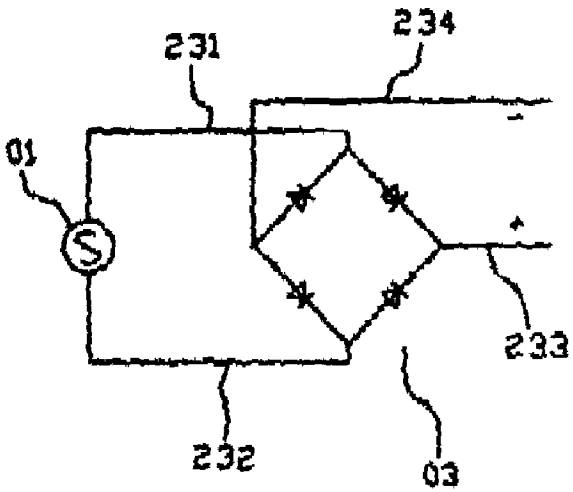
Fig 2 (Prior Art)
FIG. 2 is the prior art schematic circuit diagram of the AC/DC converter illustrated in FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 3:
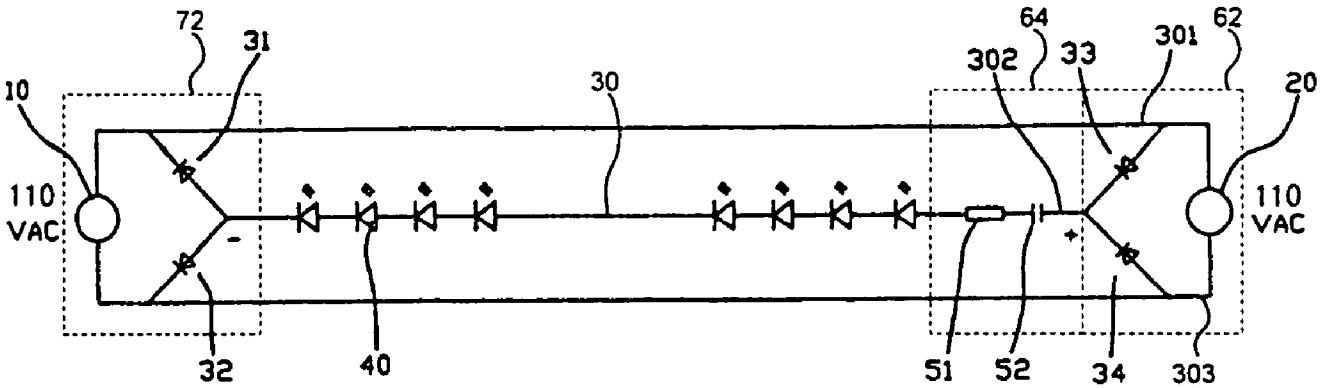
FIG. 3 is a schematic circuit diagram illustrating a simplified method of connecting an LED lighting chain, in accordance with an embodiment of the present invention.
Figure 4:
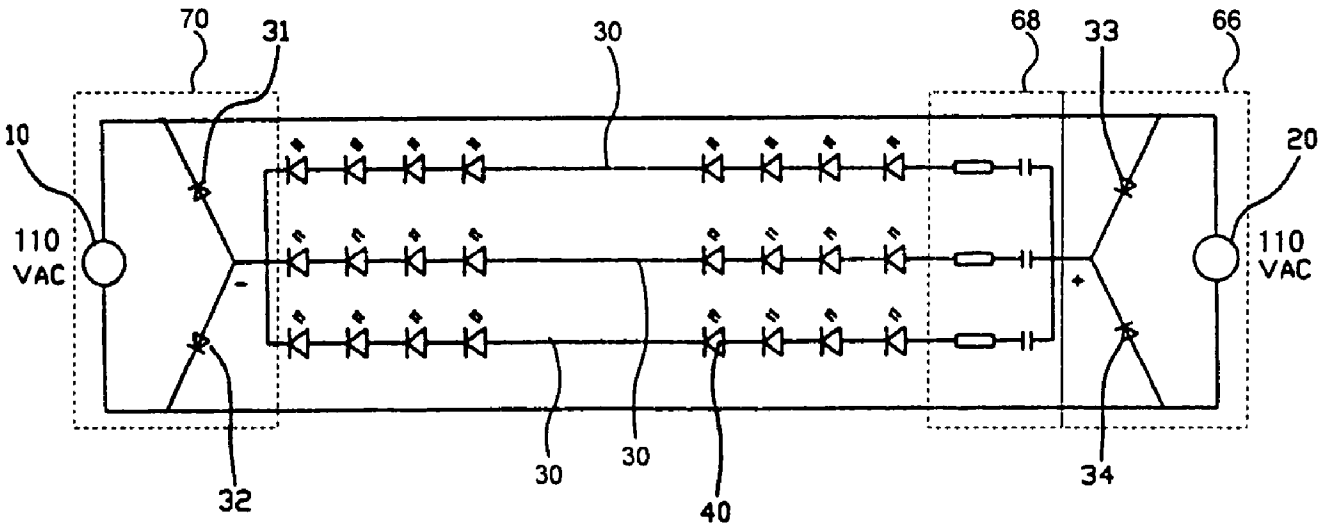
FIG. 4 is a schematic circuit diagram showing a plurality of parallel connections, in accordance with an embodiment of the present invention.

As shown in FIG. 3 and FIG. 4, the present invention comprises a front plug 10, an AC/DC converter socket comprising four rectifying diodes 31, 32, 33, and 34, and at least one LED serial set 30. The LED serial set can comprise a plurality of LEDs 40 connected serially. Each LED can reduce the input voltage a set amount, depending upon the characteristics of the LED. For example, a typical LED may drop the voltage by 2.2 volts. Thus, with a 110 volt input voltage, up to 50 LEDs may be connected in each LED serial set.

The front plug 10 can be a common household plug that is connected to a source voltage (110 VAC or 220 VAC). The device may also include a rear plug 20 that is a common household socket, coupled in parallel to the front plug to enable multiple light strings to be connected to each other from end to end. In one embodiment, multiple LED serial sets 40 can be used, in which case a parallel connection can be adopted, as shown in FIG. 4. The rear plug may alternatively be a dummy plug, a piece of plastic or other material acting as an end cap for the LED lighting chain. In the latter case, the dummy plug can have an internally wired positive and negative connection enabling the circuit to be complete.

The rectifying diodes 31, 32, 33, and 34 can be divided into two groups, with each group including two rectifying diodes. The negative ends of the two rectifying diodes 31 and 32 of the first group can be connected in parallel and their positive ends can be connected with the positive and negative ends of the front and rear plugs 10 and 20 respectively. In one embodiment, the two rectifying diodes of the first group 31 and 32 may be combined with the front plug 10 to form a package 70 and 72.

The two rectifying diodes 33 and 34 of the second group can have their positive ends connected together in parallel and their negative ends can be connected with the positive and negative ends of the front and rear plugs 10 and 20 respectively. The LED serial set 40 can be connected between the negative end of the rectifying diodes 31 and 32 of the first group and the positive end of the rectifying diodes 33 and 34 of the second group. In one embodiment, the two rectifying diodes of the second group can be combined with the rear plug 20 to form a package 62 and 66.

Of course, the connection method can be different from what is shown in FIG. 3 and FIG. 4. The position of the rectifying diodes 31 and 32 of the first group can be changed to the position of those of the second group 33 and 34, and vice visa. But if this is the case, the direction of the positive and negative ends of LEDs in the LED serial set should also be changed correspondingly.

Only three wires 301, 302 and 303 are needed for the AC/DC converter of this embodiment of the lighting chain. Wiring the lighting chain in such a manner allows one wire to be spared. This is an improvement over the conventional lighting chain used in the prior art.

In addition, to enable a more flexible selection of the number of LEDs 40 in the LED serial set, a voltage-reducing device comprising a resistance 51 and a capacitor 52 can be used. In this embodiment, by selecting the proper resistance, the voltage at the ends of the LED serial set can be changed to allow a flexible selection of the number of LEDs used in the serial set. In one embodiment, the voltage reducing device can be combined with the rear plug 20 to form a package 64 and 68. In another embodiment, the packages 64 and 68 containing the voltage reducing device can be combined with the packages 62 and 66 containing the two diodes of the second group, enabling both the voltage reducing device(s) 51 and 52 and the two diodes of the second group 31 and 34 to be packaged together with the rear plug 20.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. An improved structure for an LED lighting chain, including:

a front plug and a rear plug, each plug having at least one of a positive connection and a negative connection;

an AC to DC converter comprising four rectifying diodes;

at least one LED serial set;

the AC to DC converter, wherein the four rectifying diodes are divided into a first group and a second group; each group comprising two rectifying diodes, with negative ends of the two rectifying diodes of the first group being connected in parallel and positive ends of the two rectifying diodes of the first group being connected with the positive and negative connection of the front and rear plugs respectively, and positive ends of the two rectifying diodes of the second group being connected together in parallel and negative ends of the two rectifying diodes of the second group being connected with the positive and negative connection of the front and rear plugs respectively; and the at least one LED serial set connected between the negative ends of the rectifying diodes of the first group and the positive ends of the rectifying diodes of the second group.

2. The LED lighting chain of claim 1, further comprising a voltage-reducing device operably connected between the at least one LED serial set and the positive ends of the rectifying diodes of the second group.

3. The LED lighting chain of claim 2, wherein the voltage reducing device comprises a resistor in series with a capacitor.

4. The LED lighting chain of claim 2, wherein the voltage reducing device and the two rectifying diodes of the second group are contained in packaging for the rear plug and the two rectifying diodes of the first group are contained packaging for the front plug.

5. The LED lighting chain of claim 1, further comprising a plurality of LED serial sets connected in parallel between the negative ends of the rectifying diodes of the first group and the positive ends of the rectifying diodes of the second group.

6. The LED lighting chain of claim 1, wherein the front plug comprises a common household plug connector configured to be connected to a supply voltage.

7. The LED lighting chain of claim 6, wherein the supply voltage is 110 volts.

8. The LED lighting chain of claim 6, wherein the supply voltage is 220 volts.

9. The LED lighting chain of claim 6, wherein the rear plug comprises a common household socket connector, said socket electrically coupled in parallel to the front plug, enabling a plurality of LED lighting chains to be connected to each other from end to end.

10. The LED lighting chain of claim 9, wherein the rear plug comprises a dummy plug, said dummy plug coupled in parallel to the front plug.

11. An LED lighting chain, comprising:

a first half of a bridge rectifier comprising two rectifying diodes with negative ends connected in parallel;

a second half of a bridge rectifier comprising two rectifying diodes with positive ends connected in parallel;

a first plug having at least a positive and a negative connection and comprising the first half of the bridge rectifier with the negative ends of the rectifying diodes connected to at least one LED string and the positive ends of the rectifying diodes connected to the positive connection of the first plug and a negative connection of a second plug;

the second plug, having at least a positive and the negative connection and comprising the second half of the bridge rectifier with the positive ends of the rectifying diodes connected to at least one LED string and the negative ends of the rectifying diodes connected to the negative connection of the first plug and the positive connection of the second plug;

the LED lighting chain enabling parallel connection of at least one additional lighting chain via the second plug, with the second plug wired parallel to the first plug.

12. The LED lighting chain of claim 11, further comprising a voltage-reducing device operably connected between the at least one LED string and the positive ends of the rectifying diodes in the second half of the bridge rectifier.

13. The LED lighting chain of claim 12, wherein the voltage-reducing device comprises a resistor in series with a capacitor.

14. The LED lighting chain of claim 11, further comprising a plurality of LED strings connected in parallel between the negative ends of the rectifying diodes in the first half of the bridge rectifier of the first plug and the positive ends of the rectifying diodes in the second half of the bridge rectifier of the second plug.

15. The LED lighting chain of claim 11, wherein the first plug comprises a common household plug connector configured to be connected to a supply voltage.

16. The LED lighting chain of claim 15, wherein the supply voltage is 110 volts.

17. The LED lighting chain of claim 15, wherein the supply voltage is 220 volts.

18. The LED lighting chain of claim 11, wherein the second plug comprises a common household socket connector configured to be connected to a common household plug connector.

19. The LED lighting chain of claim 18, wherein the second plug comprises a dummy plug, said dummy plug electrically coupled in parallel to the first plug.

* * * * *